US008573191B2

(12) United States Patent
Dobbins

(10) Patent No.: US 8,573,191 B2
(45) **Date of Patent: *Nov. 5, 2013**

(54) VARIABLE PNEUMATIC SEAR FOR PAINTBALL GUN

(75) Inventor: Jerrold M. Dobbins, Kuna, ID (US)

(73) Assignee: KEE Action Sports I, LLC, Sewell, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/613,958

(22) Filed: Nov. 6, 2009

(65) Prior Publication Data

US 2010/0108049 A1 May 6, 2010

Related U.S. Application Data

(63) Continuation of application No. 12/256,832, filed on Oct. 23, 2008, now Pat. No. 8,176,908, which is a continuation of application No. 11/654,723, filed on Jan. 18, 2007, now abandoned, which is a continuation of application No. 11/183,548, filed on Jul. 18, 2005, now abandoned.

(60) Provisional application No. 60/588,912, filed on Jul. 16, 2004, provisional application No. 60/654,262, filed on Feb. 18, 2005.

(51) Int. Cl.
*F41B 11/00* (2006.01)

(52) U.S. Cl.
USPC ..... 124/73

(58) Field of Classification Search
USPC ..... 124/70–77
See application file for complete search history.

(56) References Cited

U.S. PATENT DOCUMENTS

| | | | |
|---|---|---|---|
| 71,162 | A | 11/1867 | Hall |
| 684,055 | A | 10/1901 | Gabbett-Fairfax |
| 2,116,860 | A | 5/1938 | Blaylock |
| 2,568,432 | A | 9/1951 | Cook |
| 2,817,328 | A | 12/1957 | Gale |
| 3,334,208 | A | 8/1967 | Green |

(Continued)

FOREIGN PATENT DOCUMENTS

| | | |
|---|---|---|
| EP | 1197723 | 4/2002 |
| GB | 631797 | 11/1949 |

(Continued)

OTHER PUBLICATIONS

MATRIX Owner's Manual by Dye Precision, Inc., Copyright 2003. (9 Pages).*

(Continued)

*Primary Examiner* — Jonathan C Weber
(74) *Attorney, Agent, or Firm* — Volpe and Koenig, P.C.

(57) ABSTRACT

An improved paintball gun uses a pneumatic sear to hold the firing valve closed against the high pressure gas occupying the other side of the valve. In this manner, only one operation is required between depressing the trigger and the firing of the paintball gun because a double-acting cylinder is not required as an interface between the trigger depression and actuation of the valve. The paintball gun is also substantially faster than existing electro-pneumatic paintball guns because it uses a blow forward bolt, in which higher-pressure gas is held directly behind the bolt and has only one direction to travel during the firing of the paintball gun.

8 Claims, 5 Drawing Sheets

(56) References Cited

U.S. PATENT DOCUMENTS 3,420,220 A 1/1969 Ferrando
3,788,298 A 1/1974 Hale
3,921,614 A 11/1975 Fogelgren
4,147,152 A 4/1979 Fischer et al.
4,362,145 A 12/1982 Stelcher
4,770,153 A 9/1988 Edelman
4,819,609 A 4/1989 Tippmann
4,870,945 A 10/1989 Hutchison
4,922,640 A 5/1990 Toombs
4,936,282 A 6/1990 Dobbins et al.
5,063,905 A 11/1991 Farrell
5,078,118 A 1/1992 Perrone
5,257,614 A 11/1993 Sullivan
5,265,582 A 11/1993 Bhogal
5,280,778 A 1/1994 Kotsiopoulos
5,333,594 A 8/1994 Robinson
5,349,938 A 9/1994 Farrell
5,450,839 A 9/1995 Nicolaevich et al.
5,462,042 A 10/1995 Greenwell
5,494,024 A 2/1996 Scott
5,542,406 A 8/1996 Oneto
5,572,982 A 11/1996 Williams
5,605,140 A 2/1997 Griffin
5,613,483 A 3/1997 Lukas et al.
5,630,406 A 5/1997 Dumont
5,634,456 A 6/1997 Perrone
5,727,538 A 3/1998 Ellis
5,769,066 A * 6/1998 Schneider ..... 124/75
5,771,875 A 6/1998 Sullivan
5,778,868 A 7/1998 Shepherd
5,878,736 A 3/1999 Lotuaco, III
5,913,303 A 6/1999 Kotsiopoulos
5,924,413 A 7/1999 Johnson et al.
5,954,043 A 9/1999 Mayville et al.
6,003,504 A 12/1999 Rice et al.
6,024,077 A 2/2000 Kotsiopoulos
6,065,460 A 5/2000 Lotuaco, III
6,138,656 A 10/2000 Rice et al.
6,142,136 A 11/2000 Velasco
6,233,928 B1 5/2001 Scott
6,302,092 B1 10/2001 Juan
6,311,682 B1 11/2001 Rice et al.
6,349,711 B1 2/2002 Perry et al.
6,371,099 B1 4/2002 Lee
6,439,217 B1 8/2002 Shih
6,470,872 B1 10/2002 Tiberius et al.
6,516,791 B2 2/2003 Perrone
6,532,949 B1 3/2003 McKendrick
6,550,468 B1 4/2003 Tippmann, Jr.
6,553,983 B1 4/2003 Li
6,561,176 B1 5/2003 Fujimoto et al.
6,568,381 B2 5/2003 Chang
6,618,975 B1 9/2003 Shih
6,626,165 B1 9/2003 Bhogal
6,637,420 B2 10/2003 Moritz
6,644,295 B2 11/2003 Jones
6,644,296 B2 11/2003 Gardner, Jr.
6,658,982 B2 12/2003 Cherry
6,668,478 B2 12/2003 Bergstrom
6,675,791 B1 1/2004 Alexander et al.
6,694,963 B1 2/2004 Taylor
6,705,036 B2 3/2004 Orr
6,708,685 B2 3/2004 Masse
6,732,464 B2 * 5/2004 Kurvinen ..... 42/69.01
6,763,822 B1 7/2004 Styles
6,766,795 B1 7/2004 Sullivan
6,802,305 B1 10/2004 Hatcher
6,810,871 B2 11/2004 Jones
6,832,605 B2 12/2004 Farrell
6,860,258 B2 3/2005 Farrell
6,868,846 B2 3/2005 Jzn
6,880,281 B1 4/2005 Orr
6,889,681 B1 5/2005 Alexander et al.
6,892,718 B2 5/2005 Tiberius et al.
6,901,684 B2 6/2005 Ito et al.
6,901,689 B1 6/2005 Bergstrom
6,901,923 B2 6/2005 Jones
6,915,792 B1 7/2005 Sheng
6,925,997 B2 8/2005 Sheng
7,044,119 B2 * 5/2006 Jones ..... 124/74
7,076,906 B2 7/2006 Monks et al.
7,086,393 B1 8/2006 Moss
7,100,593 B2 9/2006 Smith et al.
7,121,272 B2 * 10/2006 Jones ..... 124/77
7,185,646 B2 3/2007 Jones
D546,297 S 7/2007 Jones
7,237,544 B2 * 7/2007 Jones ..... 124/73
7,461,646 B2 12/2008 Jones
7,556,032 B2 7/2009 Jones et al.
7,591,262 B2 9/2009 Jones et al.
7,603,997 B2 * 10/2009 Hensel et al. ..... 124/77
7,610,908 B2 * 11/2009 Gardner et al. ..... 124/77
7,617,819 B2 * 11/2009 Jones ..... 124/74
7,617,820 B2 * 11/2009 Jones ..... 124/77
7,624,723 B2 * 12/2009 Gardner et al. ..... 124/80
7,640,925 B2 * 1/2010 Jones ..... 124/73
7,640,926 B2 * 1/2010 Jones ..... 124/74
7,690,373 B2 * 4/2010 Telford et al. ..... 124/74
2002/0088449 A1 7/2002 Perrone
2002/0096164 A1 7/2002 Perrone
2003/0005918 A1 1/2003 Jones
2003/0047175 A1 3/2003 Farrell
2003/0066520 A1 4/2003 Chang
2003/0079731 A1 5/2003 Dobbins
2003/0168052 A1 9/2003 Masse
2003/0221684 A1 12/2003 Rice
2004/0084038 A1 5/2004 Gabrel
2004/0084040 A1 * 5/2004 Jones ..... 124/77
2004/0200115 A1 10/2004 Monks et al.
2004/0216728 A1 11/2004 Jong
2004/0237954 A1 12/2004 Styles et al.
2004/0255923 A1 * 12/2004 Carnall et al. ..... 124/73
2005/0066952 A1 3/2005 Lai et al.
2005/0115550 A1 6/2005 Jones
2005/0115551 A1 * 6/2005 Carnall et al. ..... 124/71
2005/0115553 A1 6/2005 Garfield Jong
2005/0115554 A1 6/2005 Jones
2005/0133014 A1 6/2005 Jones
2005/0155591 A1 7/2005 Forster
2005/0183711 A1 8/2005 Eichner et al.
2005/0188977 A1 9/2005 Wygant
2005/0188978 A1 9/2005 Tiberius et al.
2005/0194558 A1 * 9/2005 Carnall et al. ..... 251/344
2005/0235976 A1 * 10/2005 Carnall ..... 124/73
2005/0268894 A1 12/2005 Styles et al.
2006/0005823 A1 1/2006 Quinn et al.
2006/0011186 A1 1/2006 Jones et al.
2006/0011187 A1 1/2006 Gardner, Jr. et al.
2006/0011188 A1 * 1/2006 Jones ..... 124/77
2006/0107939 A1 5/2006 Dobbins
2006/0124118 A1 6/2006 Dobbins
2006/0137745 A1 * 6/2006 Carnall ..... 137/505.25
2006/0162712 A1 7/2006 Yea
2006/0162714 A1 7/2006 Lai
2006/0162715 A1 7/2006 Jones
2006/0169264 A1 8/2006 Lai
2006/0169266 A1 * 8/2006 Carnall et al. ..... 124/75
2006/0207585 A1 9/2006 Liang
2006/0207587 A1 9/2006 Jones et al.
2006/0225718 A1 10/2006 Kirwan
2006/0278206 A1 12/2006 Dobbins et al.
2007/0068502 A1 3/2007 Jones et al.
2007/0151548 A1 7/2007 Long
2007/0181115 A1 8/2007 Jong
2007/0186916 A1 8/2007 Jones
2007/0209650 A1 9/2007 Jones
2007/0295320 A1 * 12/2007 Carnall et al. ..... 124/73
2009/0133682 A1 5/2009 Dobbins
2010/0083944 A1 4/2010 Dobbins
2010/0101550 A1 4/2010 Carnall
2010/0154767 A1 * 6/2010 Masse ..... 124/77

(56) References Cited

U.S. PATENT DOCUMENTS

FOREIGN PATENT DOCUMENTS

| | | |
|---|---|---|
| GB | 2198818 | 6/1988 |
| GB | 2313655 | 12/1997 |
| JP | 7225096 | 8/1995 |
| WO | 8805895 | 8/1988 |
| WO | 9813660 | 4/1998 |

OTHER PUBLICATIONS

DM4 Owner's Manual by Dye Precision, Inc., Copyright 2003. (20 Pages).*
Mills, Bill. "AirTech Matrix" (Jun. 2001), Corinthian Media Services. http://www.warpig.com/paintball/technical/paintguns/matrix/index.shtml.*
Tippmann Pneumatics, Inc. 98 Custom, $CO_2$ Powered Paintball Gun, Owner's Manual.
Indian Creek Design "Freestyle 2004" Operation Manual Version 1.1, 2004 (28 pages).
Indian Creek Design "FreeStyle: 2004" Internet Announcement, 1997 (2 pages).
Paintball 2Xtremes Magazine, "Indian Creek Designs Sponsors CFOA!", Apr. 29, 2004 (3 pages).
Bushmaster™ SI Tournament Marking Gun, Safety and Instruction Manual, 1989, www.icdpaintball.com.
Promaster SI Tournament Marking Gun, Safety and Instruction Manual, 1991, www.icdpaintball.com.
Indian Creek Design BushMaster series, Version 1.2, Model BKO, 1992-2003, www.icdpaintball.com.
BKO, Instruction Manual, Version 1.5, Indian Creek, 1992-2004, www.icdpaintball.com.
Desert Fox, Instruction Manual, Version 1.2, Indian Creek Design, Inc., 1993-1996, www.icdpaintball.com.
Puma™, Version 1.4, Instruction Manual, 1993-1997, www.icdpaintball.com.
Thunder Cat™, Instruction Manual, Version 1.4, Indian Creek Design, Inc., 1993-1997, www.icdpaintball.com.
Bobcat™, Instruction Manual, Version 1.2B, Indian Creek Design, Inc., 1993, 1994, www.icdpaintball.com.
Bob Long's Defiant, Version 1.0, Instruction Manual, 1999, www.icdpaintball.com.
Alley Cat, Instruction Manual, Indian Creek Design, Inc., www.icdpaintball.com.
Indian Creek Design BushMaster series, Version 1.8, Model B2K, 1993-2001, www.icdpaintball.com.
Indian Creek Design BushMaster Series, Version 1.6, Model B2K2, Instruction Manual, Version 1.6, 1993-2001, www.icdpaintball.com.
Indian Creek Design BushMaster series, Model B2K, Version 2.1, Instruction Manual, 1993-2003, www.icdpaintball.com.
B2K PDS, User's Manual, Version 2.1, 1993-2004, Indian Creek Design, www.icdpaintball.com.
B2K Standard, User's Manual, Version 2.1, 1993-2004, Indian Creek Design, www.icdpaintball.com.
May 6, 2009 Office Action from related co-pending U.S. Appl. No. 12/256,832.
Jan. 7, 2010 Office Action from related co-pending U.S. Appl. No. 12/256,832.
Jul. 28, 2010 Notice of Allowance from related co-pending U.S. Appl. No. 12/256,832.
Nov. 16, 2010 Notice of Allowance from related co-pending U.S. Appl. No. 12/256,832.
Jun. 9, 2010 Notice of Allowance from related co-pending U.S. Appl. No. 12/493,777.
Sep. 24, 2010 Office Action from related co-pending U.S. Appl. No. 12/493,777.
Feb. 24, 2011 Reply to Office Action from related co-pending U.S. Appl. No. 12/493,777.
Mar. 11, 2011 Notice of Allowance from related co-pending U.S. Appl. No. 12/493,777.
Jul. 13, 2011 Notice of Allowance from related co-pending U.S. Appl. No. 12/493,777.
Feb. 16, 2011 RCE and Reply from related co-pending U.S. Appl. No. 12/256,832.
Mar. 1, 2011 Non-Final Office Action from related co-pending U.S. Appl. No. 12/256,832.
Sep. 19, 2011 Notice of Allowance from related co-pending U.S. Appl. No. 12/256,832.
Jan. 13, 2012 Notice of Allowance from related co-pending U.S. Appl. No. 12/256,832.
Mar. 28, 2012 Office Action from related co-pending U.S. Appl. No. 13/323,266.
Sep. 28, 2012 Reply from related co-pending U.S. Appl. No. 13/323,266.
May 14, 2012 Continuation Application filed, assigned U.S. Appl. No. 13/470,710.
Jun. 24, 2010 Published Application from related co-pending U.S. Appl. No. 12/503,504.
Oct. 6. 2010 Office Action from related co-pending U.S. Appl. No. 12/503,504.
Apr. 6, 2011 Reply from related co-pending U.S. Appl. No. 12/503,504.
Jul. 21, 2011 Office Action from related co-pending U.S. Appl. No. 12/503,504.
Jan. 23, 2012 Reply from related co-pending U.S. Appl. No. 12/503,504.
May 23, 2012 Notice of Allowance from related co-pending U.S. Appl. No. 12/503,504.
Jun. 14, 2012 Published Application No. US 2012/0145138 A1 issued in related co-pending U.S. Appl. No. 13/323,266.
Nov. 29, 2012 Final Office Action from related co-pending U.S. Appl. No. 13/323,266.
Sep. 17, 2012 Office Action from related co-pending U.S. Appl. No. 13/470,710.
Nov. 15, 2012 Published Application No. US 2012/0285435 issued in related co-pending U.S. Appl. No. 13/470,710.
Apr. 29, 2013 Reply to Final and Terminal Disclaimer filed in related co-pending U.S. Appl. No. 13/323,266.
May 14, 2013 Notice of Allowance issued in related co-pending U.S. Appl. No. 13/323,266.
Mar. 18, 2013 Reply and Terminal Disclaimer filed in related co-pending U.S. Appl. No. 13/470,710.
Jun. 10, 2013 Notice of Allowance issued in related co-pending U.S. Appl. No. 13/470,710.

* cited by examiner

VARIABLE PNEUMATIC SEAR FOR PAINTBALL GUN

CROSS REFERENCE TO RELATED APPLICATION(S)

This application is a continuation of U.S. application Ser. No. 12/256,832 filed on Oct. 23, 2008, which is a continuation of U.S. application Ser. No. 11/654,723 filed on Jan. 18, 2007, which is a continuation of U.S. application Ser. No. 11/183,548 filed Jul. 18, 2005, which claims the benefits of U.S. Provisional Application Nos. 60/588,912 and 60/654,262 filed Jul. 16, 2004 and Feb. 18, 2005 respectively, the entire contents of all of which are all incorporated by reference as if fully set forth herein.

FIELD OF INVENTION

The field of invention is the sport of paintball, and in particular paintball markers used therein.

BACKGROUND

This invention relates generally to the construction of compressed gas guns and more particularly to the guns designed to propel a liquid containing frangible projectile, otherwise known as a "paintball". As used herein, the term "compressed gas" refers to any mean known in the art for providing a fluid for firing a projectile from a compressed gas gun, such as a CO2 tank, a nitrous tank, or any other means supplying gas under pressure. Older existing compressed gas guns generally use a mechanical sear interface to link the trigger mechanism to the hammer or firing pin mechanism. In these guns, a trigger pull depresses the sear mechanism which allows the hammer, under spring or pneumatic pressure, to be driven forward and actuate a valve that releases compressed gas through a port in the bolt, which propels a projectile from the barrel.

This design, however, has many problems, including increased maintenance, damage after repeated cycles, and a higher amount of force is required to drive the hammer mechanism backwards to be seated on the sear. Also, because the sear and resulting hammer must be made of extremely hard materials, the gun is heavy. Such weight is a disadvantage in paintball, where a player's agility works to his advantage.

To overcome the problems of a mechanical sear, people developed other solutions. One solution uses a pneumatic cylinder, which uses spring or pneumatic pressure on alternating sides of a piston to first hold a hammer in the rearward position and then drive it forward to actuate a valve holding the compressed gas that is used to fire the projectile. Although the use of a pneumatic cylinder has its advantages, it requires the use of a stacked bore, where the pneumatic cylinder in the lower bore and is linked to the bolt in the upper bore through a mechanical linkage. It also requires increased gas use, as an independent pneumatic circuit must be used to move the piston backwards and forwards. A further disadvantage is that adjusting this pneumatic circuit can be difficult, because the same pressure of gas is used on both sides of the piston and there is no compensation for adjusting the amount of recock gas, used to drive it backwards, and the amount of velocity gas, which is the amount of force used to drive it forward and strike the valve. This results in erratic velocities, inconsistencies, and shoot-down. In addition, this technology often results in slower cycling times, as three independent operations must take place. First, the piston must be cocked. Second, the piston must be driven forward. Third, a valve is opened to allow compressed gas to enter a port in the bolt and fire a projectile. Clearly, the above design leaves room for improvement.

Single-bore designs have also been developed which place the cylinder and piston assembly in the top bore, usually behind the bolt. This reduces the height of the compressed gas gun, but still requires that a separate circuit of gas be used to drive the piston in alternating directions, which then actuates a valve to release compressed gas, which drives the bolt forward to launch a paintball. These are generally known as spool valve designs. See, for instance, U.S. Pat. Nos. 6,644,295, 5,613,483 and 5,494,024.

Existing spool valve designs have drawbacks as well. Coordinating the movements of the two separate pistons to work in conjunction with one another requires very precise gas pressures, port orifices, and timing in order to make the gun fire a projectile. In the rugged conditions of compressed gas gun use, these precise parameters are often not possible. In addition, adjusting the velocity of a compressed gas gun becomes very difficult, because varying the gas pressure that launches a paintball in turn varies the pressure in the pneumatic cylinder, which causes erratic cycling.

What is needed is a compressed gas gun design that eliminates the need for a separate cylinder and piston assembly and uses a pneumatic sear instead of a pneumatic double-acting cylinder to hold the firing mechanism in place prior to firing a projectile. This allows the gun to be very lightweight and compact, and simplifies adjusting the recock gas used to cock the bolt and the gas used to fire the projectile.

SUMMARY

One aspect of the present invention provides an improved paintball gun that uses a low-pressure pneumatic sear to hold the firing valve closed against the high pressure gas occupying the other side of the valve. In this manner, only one operation is required between depressing the trigger and the firing of the paintball gun because a double-acting cylinder is not required as an interface between the trigger depression and actuation of the valve. The improved paintball gun is also substantially faster than existing electro-pneumatic paintball guns because it uses a blow forward bolt, in which higher-pressure gas is held directly behind the bolt and has only one direction to travel during the firing of the paintball gun.

In operation, a preferably normally open electro-pneumatic valve directs low pressure compressed gas to the front of the firing valve, which is connected to the bolt, which drives the valve backwards in a closed position. On the rearward side of the firing valve, higher-pressure gas is occupying the space surrounding the surface of the firing valve. When the trigger is depressed, it sends an electrical signal to the electropneumatic valve that actuates it. When actuated, the electro-pneumatic valve shuts off and vents to atmosphere the flow of low-pressure gas to the front of the firing valve. As this low pressure gas is being vented, the higher pressure gas on the rear of the firing valve overcomes the pressure on the front of the valve, and the firing valve moves forward, allowing the higher pressure gas to escape around the edges of the valve to be directed down through the center of the bolt to launch the projectile. When the electropneumatic valve is de-actuated, low-pressure gas is then directed to the front of the firing valve, driving it rearwards to seat the valve.

BRIEF DESCRIPTION OF THE DRAWING(S)

Other objects of the invention will be more readily apparent upon reading the following description of embodiments of the invention and upon reference to the accompanying drawings wherein.

DETAILED DESCRIPTION OF THE PREFERRED EMBODIMENT(S)

Figure 1:
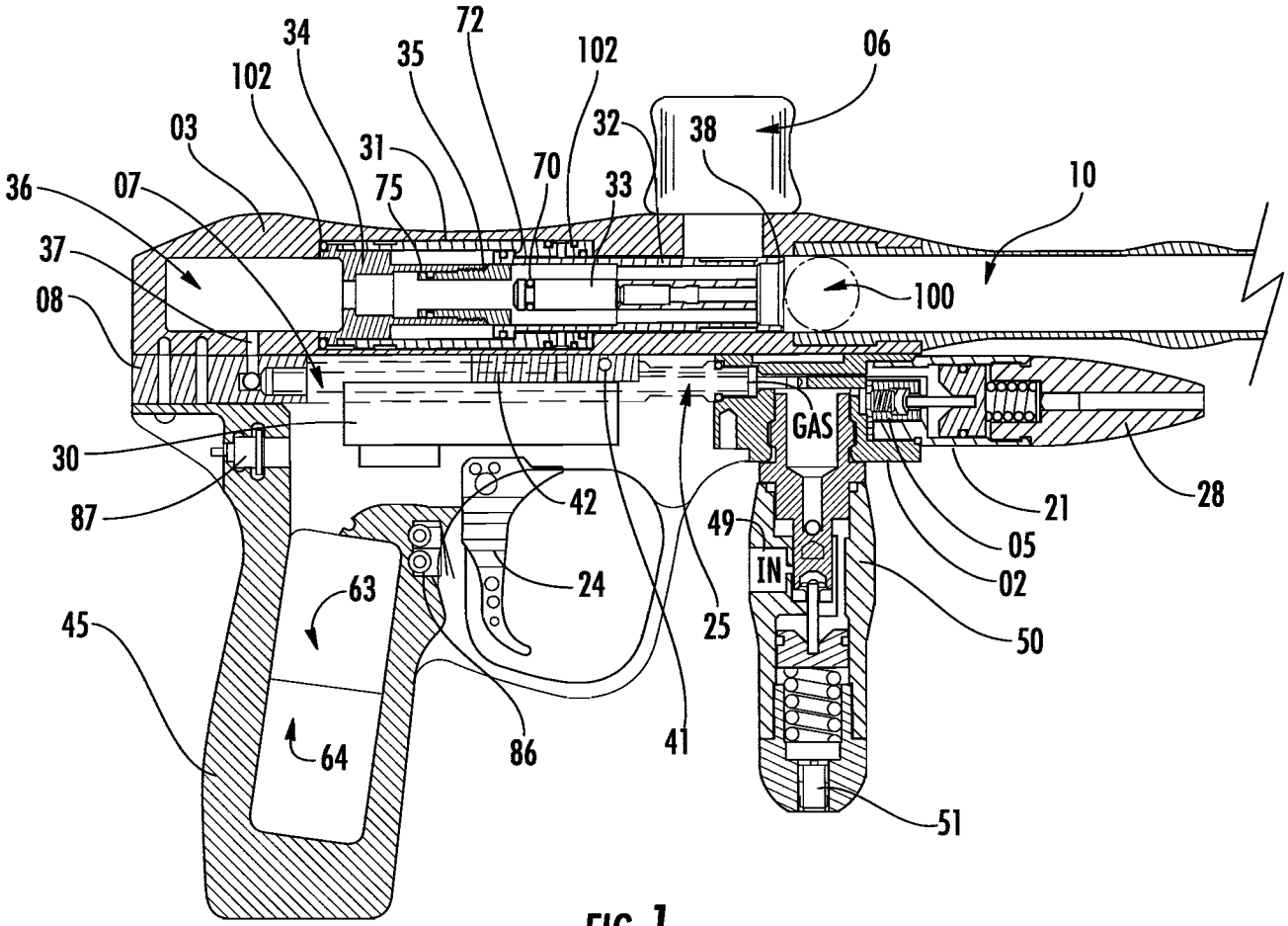
FIG. 1 is a side view of a compressed gas gun utilizing a variable pneumatic sear in the firing position.
Figure 2:
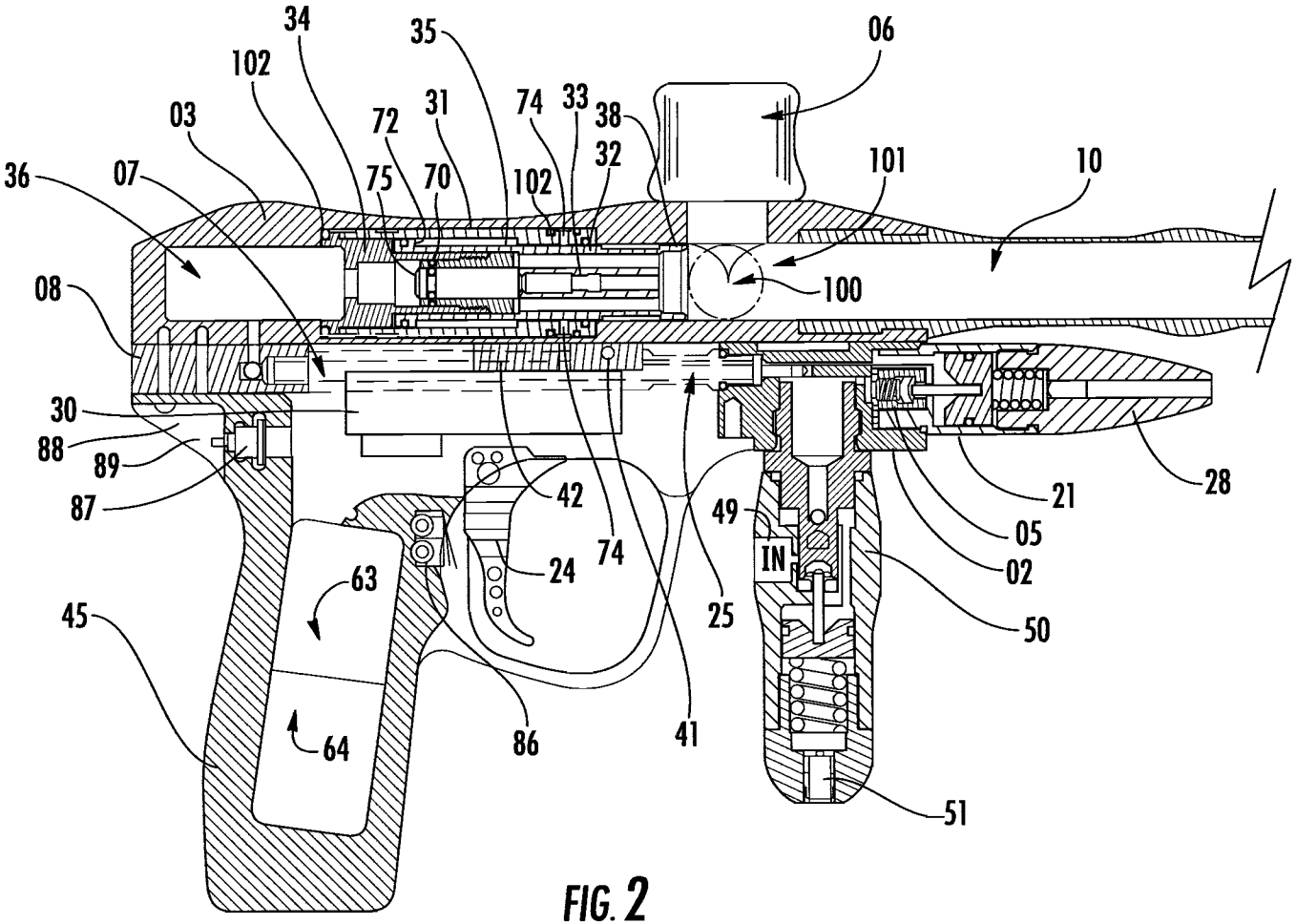
FIG. 2 is a side view of a compressed gas gun utilizing a variable pneumatic sear in the loading position.

FIGS. 1-5 illustrate of a compressed gas gun incorporating a pneumatic sear. Referring to FIGS. 1 and 2, a paintball gun generally comprises a main body 3, a grip portion 45, a trigger 24, a feed tube 6, and a barrel 10. These components are generally constructed out of metal or a suitable substance that provides the desired rigidity of these components. Main body 3 generally is connected to a supply of projectiles by feed tube 6 as understood by those skilled in the art. Main body 3 is also connected to grip portion 45, which houses the trigger 24, battery 64 and circuit board 63. The trigger 24 is operated by manual depression, which actuates micro-switch 86 directly behind trigger 24 to send an electrical signal to circuit board 63 to initiate the launching sequence. Barrel 10 is also connected to body 3, preferably directly in front of feed tube 6, to allow a projectile to be fired from the gun.

Hereinafter, the term forward shall indicate being towards the direction of the barrel 10 and rearward shall indicate the direction away from the barrel 10 and towards the rear of main body 3. Preferably forward of the grip portion 45, and also attached to main body 3, the regulator mount 2 houses both the low-pressure regulator 21 and the high-pressure regulator 50. Compressed gas is fed from preferably a compressed gas tank into the input port 49 on high-pressure regulator 50 to be directed to tube 7 to launch a projectile and to be directed to low pressure regulator 21 to cock the bolt tip 38 for loading. Both regulators 21, 50 are constructed from principles generally known to those skilled in the art, and have adjustable means for regulating compressed gas pressure.

Figure 3:
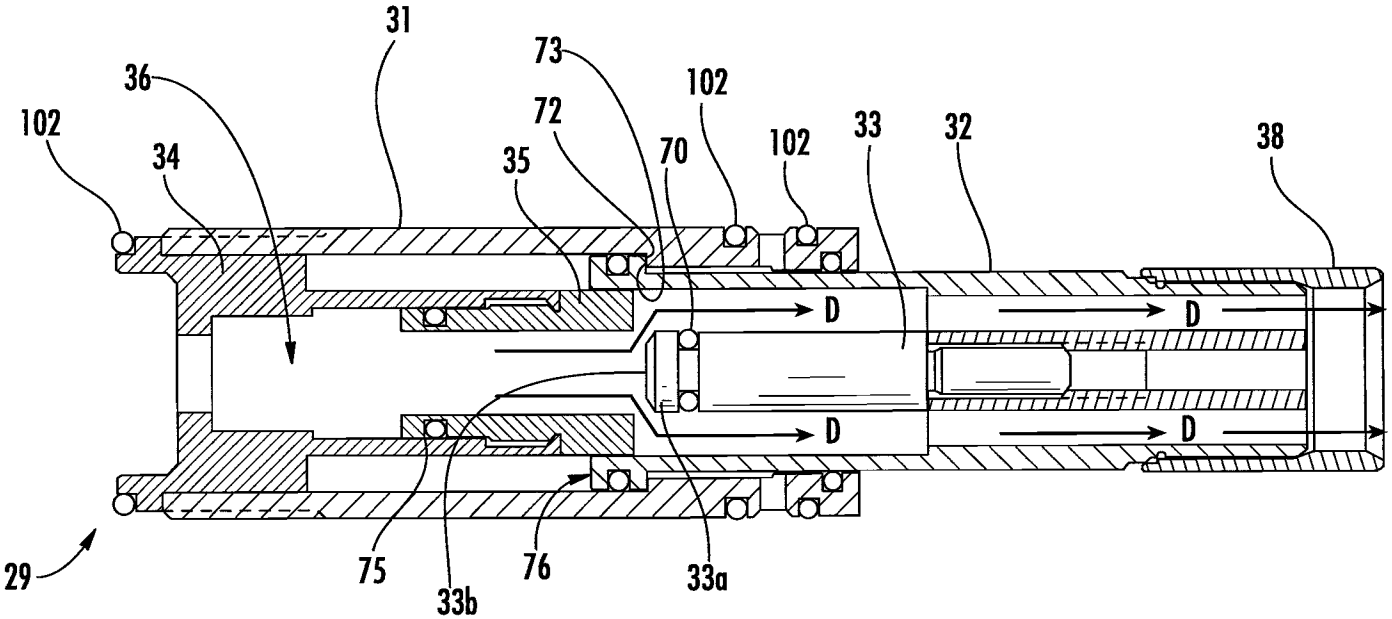
FIG. 3 is an expanded view of the variable pneumatic sear in the loading position.
Figure 4:
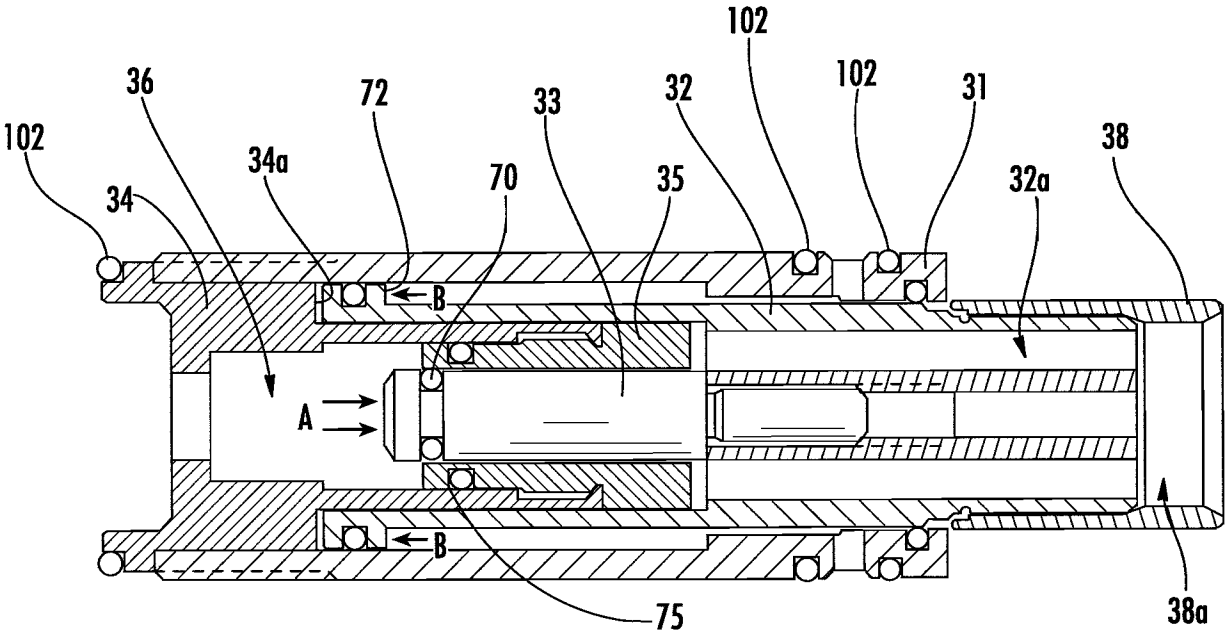
FIG. 4 is an expanded view of the variable pneumatic sear in the launching position.
Figure 5:
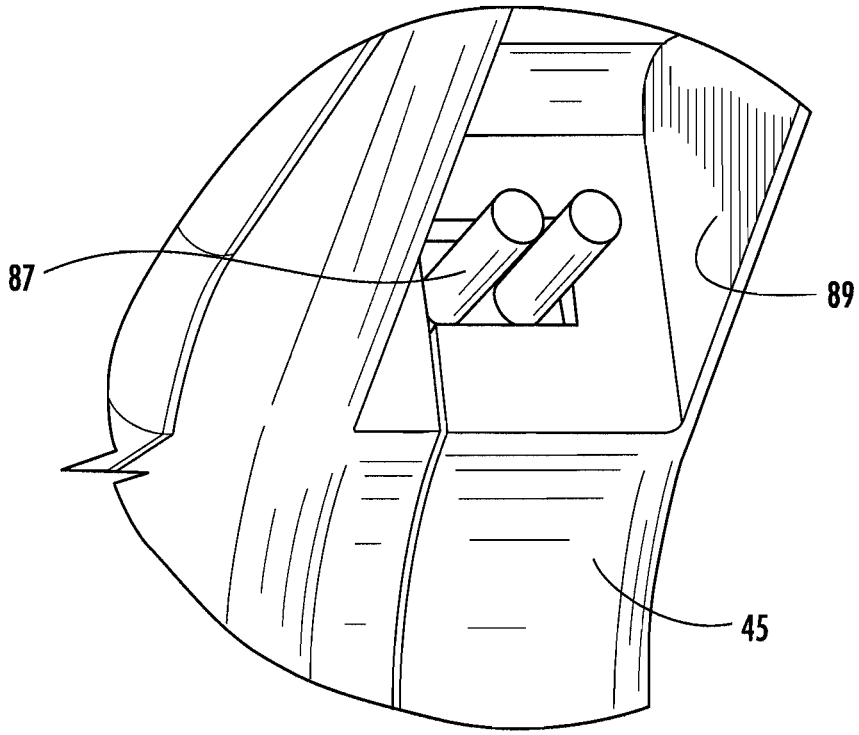
FIG. 5 is an expanded isometric view of the switches located within the recess.

Referring more particularly to FIGS. 3 and 4, housed within main body 3 is the firing mechanism of the gun. Firing mechanism preferably consists of a bolt tip 38, which is preferably constructed out of delrin or metal and is connected to piston 32, housed in cylinder body 31. Piston 32 is also constructed out of delrin or metal, and is connected to valve pin/piston 33, housed on the interior of piston 32. In the loading position, valve pin 33 is forced rearward and seal 70 (located on a rearward portion 33*a* of the valve pin 33) is pushed against the lip 75 of valve housing tip 35, holding high-pressure compressed gas A on the rearward face 33*b* of valve pin 33 and preventing the flow through bolt tip 38. All seals, including o-ring 70 are constructed out of urethane, BUNA, or TEFLON, or any other substance that effectively prevents gas leakage beyond the surface of the seal. Valve housing tip 35 is integrally connected to valve housing 34, which prevents leakage of high-pressure compressed gas around the valve housing 34. Seals 102 also prevent leakage of high-pressure gas and are placed at each connecting section of the various components. Cylinder 31 surrounds valve housing 34 and provides sealed housing for piston 32, which contains a first surface 72 for low pressure gas B to flow into to drive piston 32 rearward and seal valve pin 33 against tip 35. Valve housing 34 preferably contains an interior chamber 36 for storing compressed gas to be used to fire a projectile from the gun.

The variable pneumatic sear 29 of the compressed gas gun of the present invention preferably consists of a control valve 30, a piston 32, residing in preferably sealed cylinder housing 31. Control valve 30 directs low pressure compressed gas from low pressure regulator 21 through manifold 41 to the cylinder housing 31, allowing gas to contact first surface of piston 32, driving the piston 32 rearward to seat the valve pin 33 when de-actuated, which is considered the loading position. The low pressure compressed gas is able to drive the piston 32 rearward against high-pressure gas pressure on valve pin 33 because the surface area of first surface 72 of piston 32 is larger than that of the surface of valve pin 33. Control valve 30 preferably consists of a normally open three-way valve. When actuated, a normally open valve will close its primary port and exhaust gas from the primary port, thereby releasing pressure from the first surface of piston 32, through a port 42 drilled into manifold 41. This allows high pressure compressed gas, pushing against the smaller surface area of valve in 33, to drive pin 33 forward and break the seal by o-ring 70 to release the stored gas from valve housing 34. Compressed gas then flows around valve pin 33, through ports 32*a* in piston 32, and out through bolt tip 38 to launch a projectile from the barrel 10.

Control valve 30 is preferably controlled by an electrical signal sent from circuit board 63. The electronic control circuit consists of on/off switch 87, power source 64, circuit board 63, and micro-switch 86. When the gun is turned on by on/off switch 87, the electronic control circuit is enabled. For convenience, the on/off switch 87 (and an optional additional switches, such as that for adjacent anti-chop eye that prevents the bolt's advance when a paintball 100 is not seated within the breech) is located on the rear of the marker, within a recess 88 shielded on its sides by protective walls 89. This location protects the switch 87 from inadvertent activation during play. The switch 87 is preferably illuminated by LEDs.

When actuating switch 86 by manually depressing trigger 24, an electrical signal is sent by circuit board 63 to the control valve 30 to actuate and close the primary port, thereby releasing valve pin 33 and launching a projectile. Once the momentary pulse to the control valve 30 is stopped by circuit board 63, the electronic circuit is reset to wait for another signal from switch 86 and the gun will load its next projectile. In this manner, the electrical control circuit controls a firing operation of the compressed gas gun.

A description of the gun's operation is now illustrated. The function of the pneumatic sear is best illustrated with reference to FIGS. 3 and 4, which depict the movements of piston 32 more clearly. Compressed gas enters the high-pressure regulator 50 through the input port 49. The high-pressure regulator is generally known in the art and regulates the compressed gas to about 200-300 p.s.i. These parameters may be changed and adjusted using adjustment screw 51. which is externally accessible to a user for adjustment of the gas pressure in the high-pressure regulator. This high-pressure gas is used to actuate the firing valve and launch a projectile from the barrel 10 of the compressed gas gun. Upon passing through high-pressure regulator 50, compressed gas is fed both through gas transport tube 7 to the valve chamber 36 via manifold 8, and through port 5 to the low pressure regulator 21. Low-pressure regulator 21 is also generally known in the art. Compressed gas is regulated down to approximately between 50-125 p.s.i. by the low-pressure regulator, and is also adjusted by an externally accessible adjustment screw/cap 28, which is preferably externally manually adjustable for easy and quick adjustment. Compressed gas then passes through port 25 into manifold 41, where electro-pneumatic valve 30 directs it into cylinder housing 31 through low pressure passages 74 and low pressure gas pushes against first surface 72 on piston 32, driving it rearwards and seating seal 70 against valve housing tip 35. Note that piston's 32 movement in the rearward direction is limited by contact between the second surface 76 and a stop 34*a* on the valve housing 34.

This allows bolt tip 38 to clear the breech area of the body 3, in which stage a projectile 100 moves from the feed tube 6 and rests directly in front of bolt tip 38. The projectile is now chambered and prepared for firing from the breech. The high-pressure compressed gas, which has passed into the valve chamber 36 via high pressure passage 37, is now pushing against valve pin 33 on the rear of piston 32. The seal created by o-ring 70 on valve pin 33 is not broken because the force of the low-pressure gas on the first side of cylinder 31 is sufficient to hold the valve pin 33 rearward.

When trigger 24 is depressed, electro-pneumatic valve 30 is actuated preferably using a solenoid housed within the manifold 41, shutting off the flow of low-pressure gas to housing 31 and venting the housing 31 via manifold 41. This allows the higher pressure gas, which is already pushing against valve tip 33 from the rear, to drive valve tip 33 forward to the firing position and break the seal 72 against the housing 35. Bolt tip 38, which is connected to piston 32, pushes a projectile forward in the breech and seals the feed tube 6 from compressed gas during the first stage of launch because the valve pin 33 is still passing through valve housing tip 35 during this stage. This prevents gas leakage up the tube 6 and positions the projectile for accurate launch. Once the valve pin 33 clears the housing tip 35, a flow passage D is opened, and the higher pressure gas flows through ports 32*a*, 38*a* drilled through the interior of piston 32 and bolt tip 38 and propels the paintball from barrel 10. Note that the piston's 32 movement in the forward direction is limited by contact between the first surface 72 and a shoulder 73 within the cylinder 31.

The signal sent to electro-pneumatic valve 30 is a momentary pulse, so when the pulse ceases, the valve 30 is de-actuated. This allows low-pressure gas to enter cylinder housing 31 and drive valve piston 32 rearwards against the force exerted by high-pressure gas to the seated position and allow loading of the next projectile.

Since piston 32 has a larger surface area on its outside diameter than the surface area on the valve pin 33, low-pressure gas is able to hold high-pressure gas within the valve chamber 36 during the loading cycle of the gun. This is more advantageous than a design where a separate piston is used to actuate a separate valve, because the step of actuating and de-actuating the piston is removed from the launch cycle.

In addition, the pressures of the low pressure gas and high pressure gas may be varied according to user preference, thereby allowing for many variable pneumatic configurations of the gun and reducing problems with erratic cycling caused by using the same gas to control both the recock and launch functions of the gun. Because the mechanical sear is eliminated, the gun is also extremely lightweight and recoil is significantly reduced. The gun is also significantly faster than existing designs because the independent piston operation is eliminated.

In an alternate embodiment, the compressed gas gun can operate at one operating pressure instead of having a high-pressure velocity circuit and a low-pressure recock circuit. This is easily accomplished by adjusting the ratio of the surface sizes of the first surface 72 and the valve pin 33. In this manner, the size of the gun is reduced even more because low-pressure regulator 21 is no longer needed.

While the present invention is described as a variable pneumatic sear for a paintball gun, it will be readily apparent that the teachings of the present invention can also be applied to other fields of invention, including pneumatically operated projectile launching devices of other types. In addition, the gun may be modified to incorporate a mechanical or pneumatic control circuit instead of an electronic control circuit, for instance a pulse valve or manually operated valve, or any other means of actuating the pneumatic sear.

It will be thus seen that the objects set forth above, and those made apparent from the preceding description, are attained. It will also be apparent to those skilled in the art that changes may be made to the construction of the invention without departing from the spirit of it. It is intended, therefore, that the description and drawings be interpreted as illustrative and that the following claims are to be interpreted in keeping with the spirit of the invention, rather than the specific details. set forth.

It is also to be understood that the following claims are intended to cover all the generic and specific features of the invention herein described and all statements of the scope of the invention that, as a matter of language, might be the to fall therebetween.

What is claimed is:

1. A pneumatic paintball gun, comprising:

a cylinder including a firing mechanism moveable from a first position to a second position, the cylinder having a compressed gas storage chamber configured to receive compressed gas and the compressed gas in the compressed gas storage chamber is configured to provide a forward force on the firing mechanism;

the firing mechanism having an integral pneumatic piston extending substantially along central longitudinal axis of the firing mechanism, and an integral bolt including a forward bolt opening configured to communicate compressed gas to a forward end of the bolt for launching a paintball from the gun wherein the pneumatic piston has a diameter less than a diameter of the bolt;

a seal configured to prevent compressed gas from communicating with the forward bolt opening when the bolt is in a first position and to permit compressed gas to flow through the forward bolt opening when the bolt is in a second position;

a solenoid valve configured to regulate the supply of compressed gas to a forward surface area of the firing mechanism to hold the firing mechanism in an open position;

wherein the solenoid valve is configured to vent compressed gas from the forward surface area to allow the firing mechanism to move to a second position under the force of the compressed gas from the compressed as storage chamber, and to allow the release of compressed gas from the compressed gas storage chamber through the forward bolt opening to fire the paintball gun.

2. The paintball gun according to claim 1, wherein the solenoid valve is a three-way solenoid valve.

3. The paintball gun according to claim 1, wherein the solenoid valve is configured to vent compressed gas away from the forward surface area of the bolt in response to a firing signal.

4. A pneumatic paintball gun, comprising:

a bolt connected to a pneumatic piston, the pneumatic piston extending substantially along a central longitudinal axis of the bolt, the bolt comprising a port configured to communicate compressed gas to a forward end of the bolt for launching a paintball, the bolt slidably mounted in a cylinder, the piston having an effective surface area, the bolt having an effective surface area larger than the effective surface area of the piston, wherein the pneumatic piston has a diameter less than a diameter of the bolt;

a seal configured to prevent compressed gas from a compressed gas storage area from entering the port when the bolt and piston are in a rearward position and to permit compressed gas to be released into the port when the bolt and piston are in a forward position;

a supply port arranged to supply compressed gas to the compressed gas storage area, wherein compressed gas from the compressed gas storage area supplies a forward force on the surface area of the piston to urge the bolt and piston towards the forward position when the compressed gas storage area receives compressed gas from a source of compressed gas;

a solenoid valve arranged to regulate the supply of compressed gas to the surface area of the bolt, wherein compressed gas acting on the surface area of the bolt provides a rearward force greater than the forward force acting on the surface area of the piston to thereby hold the bolt and piston in a rearward position;

wherein the solenoid valve is configured to selectively vent compressed gas from the surface area of the bolt to allow the bolt and piston to move forward under the forward force applied by compressed gas from the compressed gas storage chamber to the surface area of the piston, and wherein the compressed gas supplying the forward force on the surface area of the piston further provides a force to fire a paintball from the gun.

5. A pneumatic paintball gun, comprising:

a pneumatic firing mechanism including a bolt connected to a pneumatic piston extending substantially along a central longitudinal axis of the bolt arranged in a single longitudinal cylinder of the paintball gun, the piston having a diameter less than a diameter of the bolt;

the firing mechanism comprising at least one first surface area and at least one second surface area;

a compressed gas storage area that supplies compressed gas to the at least one first surface area to provide a forward force on the firing mechanism when the compressed gas area receives compressed gas from a source of compressed gas; and, a solenoid valve configured to selectively supply compressed gas to the at least one second surface area to provide a rearward force on the firing mechanism that is greater than the forward force;

wherein the compressed gas acting on the at least one first surfaced area further provides a force to fire a paintball from the gun when released through the bolt.

6. The pneumatic paintball gun according to claim 5, wherein the solenoid valve supplies compressed gas to the at least one second surface area when the solenoid valve is de-actuated.

7. The pneumatic paintball gun according to claim 6, wherein the solenoid valve vents compressed gas away from the at least one second surface area when the solenoid valve is actuated.

8. The pneumatic paintball gun according to claim 5, further comprising a seal configured to prevent compressed gas from the compressed gas storage area from being released through the bolt when the bolt is in a rearward position and to allow compressed gas from the compressed gas storage area to being released through the bolt when the bolt is in a firing position.

* * * * *